US008006678B2

(12) United States Patent
Naito et al.

(10) Patent No.: US 8,006,678 B2
(45) Date of Patent: Aug. 30, 2011

(54) IGNITER SYSTEM

(75) Inventors: Tatsuya Naito, Nagano (JP); Kenichi Ishii, Nagano (JP); Shigemi Miyazawa, Nagano (JP); Ryuu Saitou, Nagano (JP)

(73) Assignee: Fuji Electric Co., Ltd. (JP)

( * ) Notice: Subject to any disclaimer, the term of this patent is extended or adjusted under 35 U.S.C. 154(b) by 121 days.

(21) Appl. No.: 12/328,462

(22) Filed: Dec. 4, 2008

(65) Prior Publication Data

US 2009/0139505 A1 Jun. 4, 2009

(30) Foreign Application Priority Data

Dec. 4, 2007 (JP) ..... 2007-313397

(51) Int. Cl.
*F02P 1/00* (2006.01)

(52) U.S. Cl. ..... 123/644; 123/623; 123/630; 123/143 R

(58) Field of Classification Search ..... 123/644, 123/623, 630, 650, 651, 143 R, 146.5 R, 123/149 C, 149 FA; 324/546
See application file for complete search history.

(56) References Cited

U.S. PATENT DOCUMENTS

| | | | | |
|---|---|---|---|---|
| 4,275,701 | A * | 6/1981 | Arguello et al. | 123/609 |
| 4,440,130 | A * | 4/1984 | Taguchi et al. | 123/406.66 |
| 4,492,213 | A * | 1/1985 | Yamamoto et al. | 123/644 |
| 4,931,940 | A * | 6/1990 | Ogawa et al. | 701/101 |
| 5,603,308 | A * | 2/1997 | Ooyabu et al. | 123/644 |
| 6,539,929 | B2 * | 4/2003 | Ito et al. | 123/630 |
| 6,814,066 | B2 * | 11/2004 | Ando | 123/644 |
| 7,051,724 | B2 * | 5/2006 | Uruno et al. | 123/644 |
| 2011/0031979 | A1 * | 2/2011 | Gillberg et al. | 324/546 |

FOREIGN PATENT DOCUMENTS

| | | | |
|---|---|---|---|
| JP | 9-42129 | A | 2/1997 |
| JP | 2002-138935 | A | 5/2002 |

* cited by examiner

*Primary Examiner* — John T Kwon
(74) *Attorney, Agent, or Firm* — Rossi, Kimms & McDowell LLP

(57) ABSTRACT

A coil failure detection circuit detects a rise of a collector current of an IGBT and a timer circuit measures the length of a rise period. If the rise is not a normal one, an electronic control unit judges that a coil failure has occurred. The electronic control unit turns off the IGBT to prevent misfires and stops a flow of fuel gas to a combustion chamber to prevent melting or deterioration of a catalyst.

10 Claims, 12 Drawing Sheets

IGNITER SYSTEM

BACKGROUND

The present invention relates to an igniter system using a power IC which incorporates a vertical power semiconductor device.

FIG. 12 is a block circuit diagram of a conventional igniter system that includes an IGBT 1 (insulated-gate bipolar transistor) as a switching element; a current detection resistor 3 which is connected to a current detection emitter terminal (sense emitter terminal) of the IGBT 1; a gate resistor 4 for the IGBT 1; a current limiting circuit 31; an overheat detection circuit 32; and a self-shutoff circuit 33. The operations of the current limiting circuit 31, the overheat detection circuit 32, and the self-shutoff circuit 33 will be described later. The IGBT 1 and protection circuits such as the current limiting circuit 31, the overheat detection circuit 32, and the self-shutoff circuit 33 are formed on the same semiconductor substrate and constitute a power IC 101.

The power IC 101 is combined with an ignition coil 103 to constitute an ignition device 100 for an internal combustion engine. The ignition device 100, a combustion chamber 300 having an ignition plug 18, and an engine control unit (hereinafter referred to as ECU) including a gate drive circuit 201 for the IGBT 1 constitute an igniter system.

The ignition coil 103 is composed of a primary coil 14 which is connected to the IGBT 1, a secondary coil 15 which is connected to the ignition plug 18, and a core 16. A current flowing through the primary coil 14 is on/off-controlled by the IGBT 1.

The ECU 200 is composed of various control circuits for controlling the entire internal combustion engine system including the igniter system, and is equipped with the IGBT gate drive circuit 201 which outputs, to the power IC 101, a gate signal for on/off-controlling the IGBT 1. The ECU 200 is also equipped with a control circuit for controlling the flow of fuel or fuel gas being sent to the combustion chamber 300 from a fuel tank 400 via a valve 500. Furthermore, the ECU 200 outputs, to the power IC 101, a gate signal for turning off the IGBT 1 in response to a signal that is supplied from each of the protection circuits formed in the power IC 101.

Next, the operation of the igniter system will be described. When the IGBT 1 is turned on, a primary current starts to flow through the primary coil 14. The primary current is a current that flows through the IGBT 1, that is, a collector current of the IGBT 1. The primary current i increases with a slope di/dt=VB/Lc, where VB is a power supply voltage and Lc is the inductance of the ignition coil 103. When the primary current has flowed for a prescribed time, an off signal is supplied from the gate drive circuit 201 of the ECU 200 to the gate of the IGBT 1, whereupon the IGBT 1 is turned off. The prescribed time is set in the ECU in advance according to the engine rotation speed.

When the IGBT 1 is turned off, the energy stored in the primary coil 14 is transmitted to the secondary coil 15, whereby the voltage across the ignition plug 18 of the combustion chamber 300 is increased and the ignition plug 18 is discharged. Upon discharge, the unburned gas that has flowed into the engine (combustion chamber 300) is burned explosively with the aid of a catalyst and thereby pushes down the piston and rotates the engine. The engine rotation speed is varied by varying the frequency of reciprocation of the piston by varying the discharge frequency.

The protection circuits formed in the power IC 101 will be described below. The IGBT 1 is used as a switching element for on/off (energization/shutoff)-controlling the primary current of the ignition coil 103.

The following protection circuits for protection against overcurrent, overheat, and abnormal energization (surge current) are provided in the power IC 101 which is part of the ignition device 100 for an internal combustion engine. As for overcurrent, the current limiting circuit 31 limits the primary current of the ignition coil 103 to a preset value by controlling the gate voltage by detecting the primary current. This circuit prevents destruction due to overcurrent. As for overheating, the overheat detection circuit 32 detects the chip temperature and, if it becomes higher than a prescribed temperature, shuts out the primary current forcibly by short-circuiting the gate to the ground. This circuit prevents abnormal heating of the IGBT 1 and thereby prevents its thermal destruction. The chip temperature is detected by a diode that is formed in the chip. More specifically, the temperature dependence of the forward voltage drop of the diode is utilized. As for abnormal energization, the timer-type self-shutoff circuit 33, which is equipped with a timer for measuring the on-time of an ignition signal, shuts off the primary current forcibly by short-circuiting the gate to the ground when the ignition signal has been on for more than a prescribed time. Thin-line arrows in the figures that are associated with the current limiting circuit 31, the overheat detection circuit 32, and the self-shutoff circuit 33 indicate exchange of signals.

The use of the above protection circuits secures the necessary level of reliability of the igniter system because upon occurrence of an abnormality the corresponding protection circuit turns off the IGBT 1 and the supply of fuel (unburned gas) to the combustion chamber 300 is stopped by the valve 500 in response to an output signal of the ECU 200.

JP-A-9-42129 discloses a one-chip device for reliably detecting disconnection or short-circuiting of an ignition control signal line and for preventing re-energization during an on-period of the ignition control signal. The one-chip device is composed of an IGBT for controlling energization/shutoff of the primary current of an ignition circuit, a current limiting circuit for limiting a current flowing through the IGBT, a thermal shutoff circuit for shutting off the energization of the primary current forcibly upon occurrence of an abnormality, and a latch circuit for latching an output of the thermal shutoff circuit.

In recent years, it has come to be required to further increase the reliability of the igniter system by detecting not only the above kinds of abnormalities but also a coil failure. If a coil failure occurs, ignition may fail to cause misfires. If misfires occur, the combustion chamber 300 is filled with unburned gas and the catalyst (noble metal such as palladium or platinum) existing in the combustion chamber 300 is exposed to the unburned gas and thereby oxidized. The temperature of the catalyst increases rapidly, as a result of which the catalyst is melted or deteriorated. Once the catalyst is melted or deteriorated, ignition no longer succeeds. The reliability of the igniter system is thus lowered.

Examples of coil failures are primary coil layer short-circuiting, secondary coil layer short-circuiting, and secondary coil disconnection. The coil layer short-circuiting is a phenomenon that the coating of a coil wire that is wound in layers is damaged locally to cause contact between portions of the coil wire. If this phenomenon occurs, the inductance of the ignition coil is varied.

SUMMARY OF THE INVENTION

The present invention is directed to solving the above-described problem, and thereby providing an igniter system that is increased in reliability by preventing misfires and melting or deterioration of the catalyst due to a coil failure.

An igniter system according to a first aspect of the invention comprises an ignition coil; a switching element for turning on and off a current flowing through the ignition coil; and a control circuit for the switching element, the control circuit comprising a current detecting device that detects a current flowing through the switching element; measuring device that measures a length of a period from a time point when the current flowing through the switching element that is increasing exceeds a first current setting value to a time point when it reaches a second current setting value that is larger than the first current setting value; a judgment circuit for judging whether the measured length of the period is shorter than a preset lower limit reference length or longer than a preset upper limit reference length; and output device that outputs a signal for turning off the switching element if the judgment circuit judges that the measured length of the period is shorter than the lower limit reference length or longer than the upper limit reference length.

An igniter system according to a second aspect of the invention comprises a power IC in which an ignition coil and a switching element for turning on and off a current flowing through the ignition coil are integrated together; an engine control unit for controlling the switching element and performing engine control; and a combustion chamber, wherein the power IC comprises current detecting device that detects a current flowing through the switching element; and output device that outputs, to the engine control unit, a signal for failure detection during a period from a time point when the current flowing through the switching element that is increasing exceeds a first current setting value to a time point when it reaches a second current setting value that is larger than the first current setting value; and wherein the engine control unit comprises a timer circuit for measuring a duration of the signal for failure detection; a judgment circuit for judging whether the measured duration is shorter than a preset lower limit reference length or longer than a preset upper limit reference length; and stop signal output device that judges that the ignition coil has failed and outputs a stop signal for stopping the igniter system if the judgment circuit judges that the measured duration is shorter than the lower limit reference length or longer than the upper limit reference length.

The igniter system according to the second aspect of the invention may be such that the output device comprises switching device that pulls down a gate voltage of the switching element during the period from the time point when the current flowing through the switching element that is increasing exceeds the first current setting value to the time point when it reaches the second current setting value, and that the timer circuit measures a length of the period when the gate voltage is pulled down.

The igniter system according to the second aspect of the invention may be such that the power IC comprises a Vcc terminal for connection to an external power source, that the output device comprises a switching device that pulls down a voltage of the Vcc terminal during the period from the time point when the current flowing through the switching element that is increasing exceeds the first current setting value to the time point when it reaches the second current setting value, and that the timer circuit measures a length of the period when the voltage of the Vcc terminal is pulled down.

The igniter system according to the second aspect of the invention may be such that the power IC comprises an ST terminal through which to receive a reference potential of the engine control unit, that the output device comprises switching device for pulling up or down a voltage of the ST terminal during the period from the time point when the current flowing through the switching element that is increasing exceeds the first current setting value to the time point when it reaches the second current setting value, and that the timer circuit measures a length of the period when the voltage of the ST terminal is pulled up or down.

The current detecting device may comprise an L current detection circuit for outputting information indicating that the current flowing through the switching element has reached the first current setting value and an H current detection circuit for outputting information indicating that the current flowing through the switching element has reached the second current setting value; and the switching device may be set by the output signal of the L current detection circuit and is reset by output signal of the H current detection circuit.

An igniter system according to a third aspect of the invention comprises a power IC in which an ignition coil and a switching element for turning on and off a current flowing through the ignition coil are integrated together; an engine control unit for controlling the switching element and performing engine control; and a combustion chamber, wherein the engine control unit comprises a dv/dt detection circuit that detects a slope of a turn-off voltage of the switching element; a slope judging circuit for judging whether the slope of the turn-off voltage of the switching element is smaller than a preset lower limit reference slope or larger than a preset upper limit reference slope; and stop signal output device for judging that the ignition coil has failed and outputting a stop signal for stopping the igniter system if the slope judging circuit judges that the slope of the turn-off voltage of the switching element is smaller than the lower limit reference slope or larger than the upper limit reference slope.

An igniter system according to a fourth aspect of the invention comprises a power IC in which an ignition coil and a switching element for turning on and off a current flowing through the ignition coil are integrated together; an engine control unit for controlling the switching element and performing engine control; and a combustion chamber, wherein the power IC comprises turn-off voltage detecting device that detects a period when a turn-off voltage of the switching element is higher than a predetermined voltage; and output device for outputting, to the engine control unit, a signal for failure detection during the period when the turn-off voltage of the switching element is higher than the predetermined voltage; and wherein the engine control unit comprises a timer circuit for measuring a duration of the signal for failure detection; a judgment circuit that judges whether the measured duration is shorter than a preset reference length; and stop signal output device for judging that the ignition coil has failed and outputting a stop signal for stopping the igniter system if the judgment circuit judges that the measured duration is shorter than the preset reference length.

The igniter system according to the fourth aspect of the invention may be such that the output device comprises switching device for pulling up a gate voltage of the switching element during the period when the turn-off voltage of the switching element is higher than the predetermined voltage, and that the timer circuit measures a length of the period when the gate voltage is pulled up.

The igniter system according to the fourth aspect of the invention may be such that the power IC comprises a Vcc terminal for connection to an external power source, that the output device comprises switching device for pulling down a voltage of the Vcc terminal during the period when the turn-off voltage of the switching element is higher than the predetermined voltage, and that the timer circuit measures a length of the period when the voltage of the Vcc terminal is pulled down.

The igniter system according to the fourth aspect of the invention may be such that the power IC comprises an ST terminal through which to receive a reference potential of the engine control unit, that the output device comprises switching device for pulling up or down a voltage of the ST terminal during the period when the turn-off voltage of the switching element is higher than the predetermined voltage, and that the timer circuit measures a length of the period when the voltage of the ST terminal is pulled up or down.

The stop signal may be at least one of a signal for turning off the switching element and a signal for shutting off fuel being supplied to the combustion chamber.

A low voltage circuit may be integrated in the power IC, and a voltage of a main power source for operation of the ignition coil may be supplied to the low voltage circuit as a power supply voltage after being lowered by a voltage reduction circuit.

According to the invention, a coil failure detection circuit is additionally provided in the power IC, whereby a coil failure is detected, a fail signal is transmitted to an ECU, and an IGBT is turned off to shut off a coil current and prevent misfires. At the same time, the flow of unburned gas (fuel) is shut off, whereby the time when a catalyst is exposed to unburned gas is shortened and melting or deterioration of the catalyst is prevented. As a result, the reliability of the igniter system can be increased.

A dv/dt detection circuit for detecting the slope of a turn-off voltage of the IGBT is provided in the ECU, whereby a coil failure is detected and the IGBT is turned off to shut off a coil current and prevent misfires. At the same time, the flow of unburned gas is shut off, whereby the time when a catalyst is exposed to unburned gas is shortened and melting or deterioration of the catalyst is prevented. As a result, the reliability of the igniter system can be increased.

BRIEF DESCRIPTION OF THE DRAWINGS

The invention will be described with reference to certain preferred embodiments thereof and the accompanying drawings, wherein.

DETAILED DESCRIPTION OF THE PREFERRED EMBODIMENTS OF THE INVENTION

Embodiments of the present invention will be hereinafter described. The same components as in the conventional configuration will be given the same reference symbols.

Embodiment 1

Figure 1:
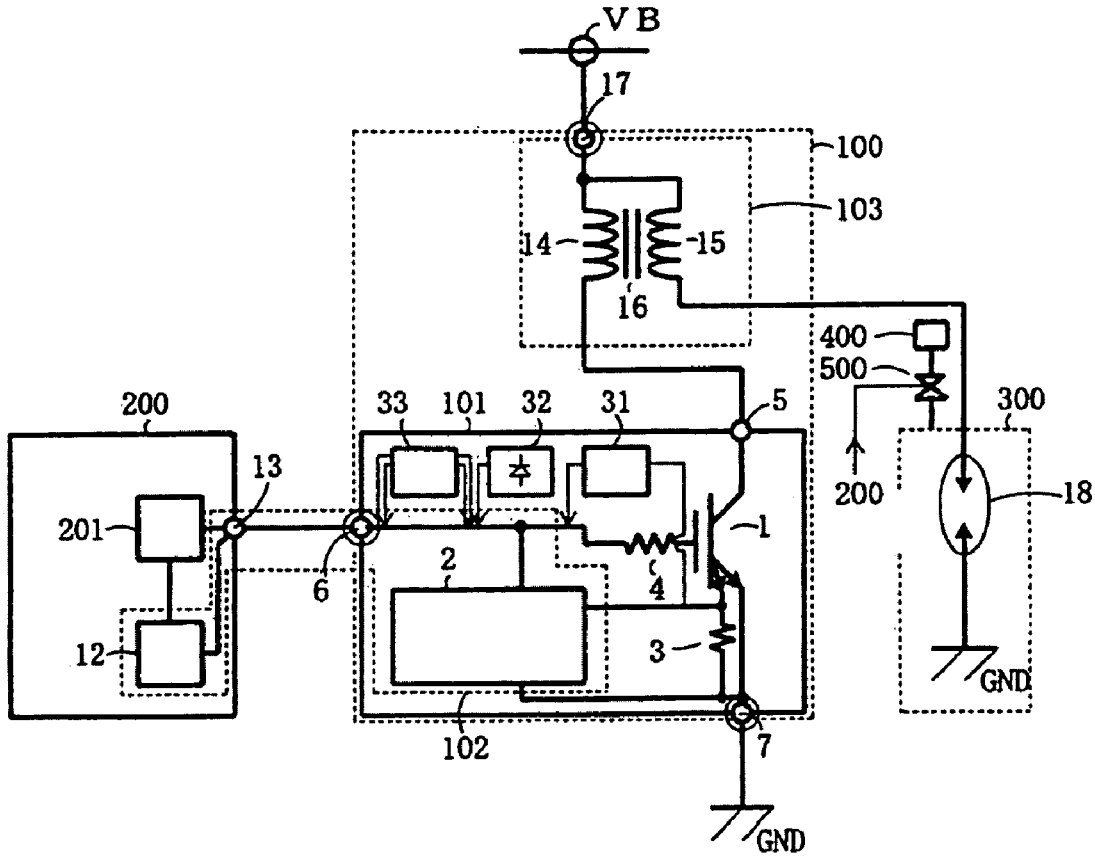
FIG. 1 is a block circuit diagram of an igniter system according to a first embodiment of the invention.

FIG. 1 is a block circuit diagram of an igniter system according to a first embodiment of the invention. The igniter system according to the first embodiment is composed of an ignition device 100 for an internal combustion engine which consists of a power IC 101 and an ignition coil 103, a combustion chamber 300 having an ignition plug 18, and an ECU 200. The power IC 101 is configured in such a manner that an IGBT 1, various protection circuits (current limiting circuit 31, overheat detection circuit 32, and self-shutoff circuit 33), and a coil failure detection circuit 2 are formed on the same semiconductor substrate.

A gate drive circuit 201 and a timer circuit 12 are formed in the ECU 200. The coil failure detection circuit 2 and the timer circuit 12 constitute a coil failure judgment circuit 102. An overvoltage prevention circuit etc. (not shown) are also formed in the power IC 101. The power IC 101 is integrated with the ignition coil 103 and they constitute the ignition device 100 for an internal combustion engine. The power IC 101 is a single semiconductor chip.

It is not necessary to use the ECU 200 if the igniter system is configured in such a manner that the IGBT 1 is turned off on the basis of an output of the coil failure judgment circuit 102 when the coil failure judgment circuit 102 detects a failure in the ignition coil 103. However, to perform such a protective operation as shutting off of the supply of fuel (described later) at the same time, an output of the coil failure judgment circuit 102 should be transmitted to the ECU 200 to cause the ECU 200 to perform a protective operation. An example in which the ECU 200 is used will be described below.

Figure 2A:
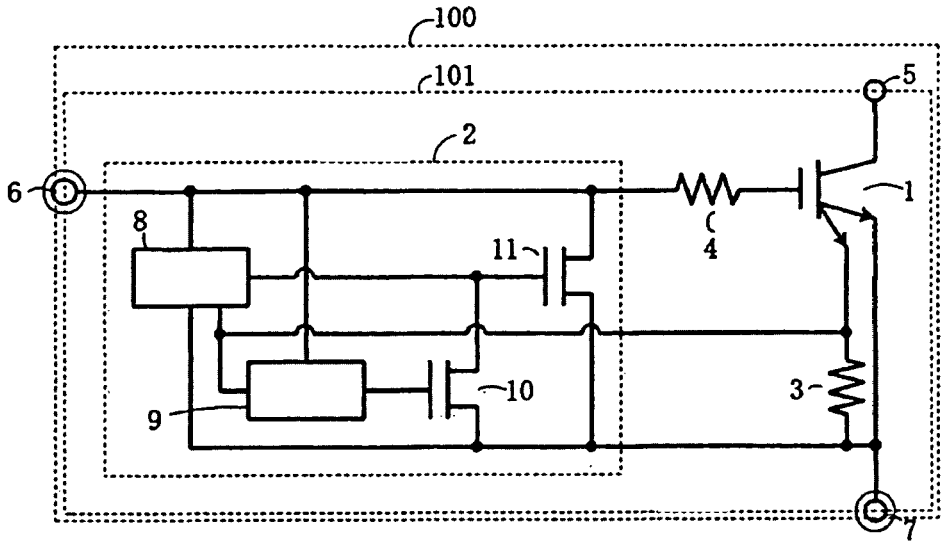
FIGS. 2A and 2B are a block circuit diagram and a timing chart, respectively, illustrating an IGBT 1 and a coil failure detection circuit 2 shown in FIG. 1.
Figure 2B:
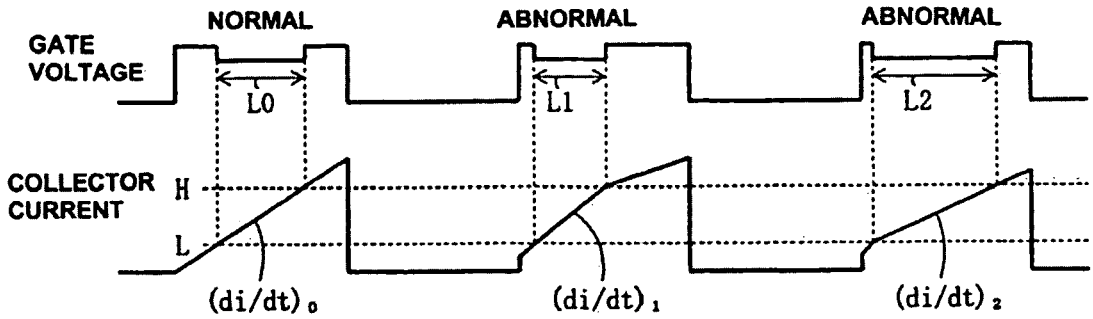

FIGS. 2A and 2B are a block circuit diagram and a timing chart, respectively, illustrating the IGBT 1 and the coil failure detection circuit 2 shown in FIG. 1. The block circuit diagram of FIG. 2A shows only the IGBT 1 and the coil failure detection circuit 2 shown in FIG. 1 (the protection circuits 31-33 are not shown). As shown in FIG. 2A, one end of a resistor 3 that is connected to the sense emitter of the IGBT 1 is also connected to an L current detection circuit 8 and an H current detection circuit 9. The output of the L current detection circuit 8 is connected to the gate of an NMOS 11 and the output of the H current detection circuit 9 is connected to the gate of the NMOS 10. The L current detection circuit 8 and the H current detection circuit 9 constitute a collector current rise detection circuit. The drain of the NMOS 10 is connected to the gate of the NMOS 11, and the drain of the NMOS 11 is connected to the gate of the IGBT 1 via a resistor 4. The main emitter of the IGBT 1, the other end of the resistor 3, and the sources of the NMOSs 10 and 11 are connected to the ground GND. Power to the L current detection circuit 8 and the H current detection circuit 9 is supplied from a gate terminal 6. A collector terminal 5 is an internal terminal of the ignition device 100 for an internal combustion engine, and the gate terminal 6 and an emitter terminal 7 are terminals, for connection to external circuits, of the ignition device 100. A VB terminal 17 of the ignition coil 103 is also a terminal of the ignition device 100.

FIG. 2B shows a gate voltage waveform and a collector current waveform that are normal and gate voltage waveforms and collector current waveforms that are abnormal (two examples). First, the example that the ignition coil 103 is normal will be described with reference to the left-hand waveforms. When an on-signal gate voltage is input to the gate of the IGBT 1, a collector current i starts to flow and rises with a constant slope di/dt. The voltage across the resistor 3 which is connected to the sense emitter of the IGBT 1 increases in proportion to the magnitude of the collector current. That is, the collector current is monitored by the resistor 3. When the collector current (actually, the voltage across the resistor 3) has reached an L level that is set in the L current detection circuit 8, an on signal is supplied to the gate of the NMOS 11 from the L current detection circuit 8, whereby the drain voltage of the NMOS 11 is decreased by 0.5 V and the gate voltage of the IGBT 1 (i.e., the voltage of the gate terminal 6) is pulled down by 0.5 V. The pull-down voltage for the gate voltage is set in such a range as not to influence the on-characteristic of the IGBT 1. That is, the pull-down voltage should be such as to leave the IGBT 1 on even if the gate voltage is pulled down and to allow the ECU 200 to detect reduction of the gate voltage.

When the collector current (actually, the voltage across the resistor 3) has reached an H level that is set in the H current detection circuit 9, an on signal is supplied to the gate of the NMOS 10 from the H current detection circuit 9, whereby the NMOS 10 is turned on and its drain voltage becomes equal to the ground potential. The NMOS 11 is thereby turned off, whereupon the gate voltage of the IGBT 1 returns to the original value and the pulled-down state of the gate terminal 6 is canceled.

The collector current increases further. When a prescribed time has elapsed from the start of flow of the collector current, the gate voltage of the IGBT 1 is made lower than the threshold voltage (e.g., 0 V) and the IGBT 1 is turned off, whereupon the ignition plug 18 (see FIG. 1) is ignited. The IGBT 1 is turned on again after a lapse of a prescribed time. The above series of operations is performed repeatedly.

Information indicating that the gate voltage is in a pulled-down state is transmitted as a signal for failure detection to the timer circuit 12 (see FIG. 1) of the ECU 200, and the timer circuit 12 measures the length of the pull-down period. The ECU 200 compares the length of the pull-down period with reference lengths and judges whether a coil abnormality has occurred. In a normal state (i.e., a state that no coil abnormality has occurred), the length L0 of the pull-down period is almost constant. The ECU 200 compares the length L0 with reference lengths LrefL and LrefH. LrefL and LrefH are a lower limit reference value and an upper limit reference value to be used for judgment as to whether the length of the pull-down period is normal. If a coil abnormality has occurred, the coil inductance is varied and the turn-off collector voltage is thereby varied.

The waveforms shown at the center of FIG. 2B correspond to a case that the collector current rises more steeply due to a coil abnormality. If the slope di/dt of the rise of the collector current i is made steeper due to a coil failure, the time from a time point when the collector current reaches the L level to a time point when it reaches the H level becomes shorter. Therefore, the length of the pull-down period of the gate voltage becomes shorter, that is, the length L1 of the pull-down period that is measured by the timer circuit 12 is shorter than the length L0 of the normal state. The ECU 200 compares the length L1 of the pull-down period with LrefL and LrefH. If L1<LrefL, the ECU 200 judges that a coil abnormality has occurred and outputs a signal for stopping the igniter system.

In the example of FIG. 1, an off signal is supplied from the gate drive circuit 201 of the ECU 200 to the gate terminal 6, whereby the IGBT 1 is turned off and misfires are prevented. At the same time, a signal for closing a valve 500 is supplied from the ECU 200 to the valve 500, whereby the supply of fuel from a fuel tank 400 to the combustion chamber 300 is stopped. Since the flow of unburned gas is stopped, the time when a catalyst in the combustion chamber 300 is exposed to unburned gas is shortened and the catalyst is thereby prevented from being melted or deteriorated. The reliability of the igniter system can thus be increased.

As for the fuel shutoff, the output of fuel from the fuel tank 400 may be stopped. As a further alternative, the supply of mixture gas of vaporized fuel and air to the combustion chamber 300 may be shut off.

The left-hand waveforms in FIG. 2B correspond to a case that the collector current rises more gently due to a coil abnormality. If the slope di/dt of the rise of the collector current i is made gentler, the length L2 of the pull-down period of the gate voltage becomes longer. The ECU 200 compares the length L2 of the pull-down period with LrefL and LrefH. If L2>LrefH, the ECU 200 judges that a coil abnormality has occurred and an off signal is supplied from the gate drive circuit 201 of the ECU 200 to the gate terminal 6 via a terminal 13, whereby the IGBT 1 is turned off and misfires are prevented. At the same time, a signal for closing the valve 500 is supplied from the ECU 200 to the valve 500, whereby the supply of fuel from the fuel tank 400 to the combustion chamber 300 is stopped. Since the flow of unburned gas is stopped, the time when the catalyst in the combustion chamber 300 is exposed to unburned gas is shortened and the catalyst is prevented from being melted or deteriorated. The reliability of the igniter system can thus be increased.

As described above, the first embodiment is of a current detection type because the L current detection circuit 8 and the H current detection circuit 9 monitor the rise of a collector current. And the first embodiment is of a type that the gate voltage of the IGBT 1 is pulled down according to the relationships between the collector current and the threshold values (L level and H level) of the current detection circuits 8 and 9.

For example, as shown in the timing chart of FIG. 2B, a rise of the collector current is detected and the gate voltage is pulled down by about 0.5 V for the time length L0, L1 or L2. More specifically, when the collector current reaches the lower prescribed level (L level), the L current detection circuit 8 operates to pull down the gate voltage by about 0.5 V. When the collector current thereafter reaches the higher prescribed level (H level), the H current detection circuit 9 operates to cancel the pulling-down of the gate voltage and return the gate voltage to the original value. If the collector current rises in an abnormal manner, the length of the pull-down period of the gate voltage is different from the length of the normal state.

As described above, if the rise of the collector current is made steeper due to a coil failure, the length of the pull-down period becomes shorter than the length L0 of the normal state. Conversely, if the rise of the collector current is made gentler, the length of the pull-down period becomes longer than the length L0 of the normal state.

Whether an abnormality has occurred is judged by measuring the length L0, L1, or L2 of the pull-down period with the timer circuit 12 which is provided in the ECU 200.

In the above scheme, the power IC 101 has three terminals, that is, the collector terminal 5, the gate terminal 6, and the emitter terminal 7. And the ignition device 100 for an internal combustion engine which incorporates the power IC 101 has three terminals, that is, the VB terminal 17 which is a buttery terminal, the gate terminal 6, and the emitter terminal 7. The gate terminal 6 and the emitter terminal 7 are common to the power IC 101 and the ignition device 100, and the collector terminal 5 is an internal connection terminal. The number of terminals is the same as in the conventional system. The ignition device 100 for an internal combustion engine can detect a coil failure using these terminals.

Embodiment 2

Figure 3A:
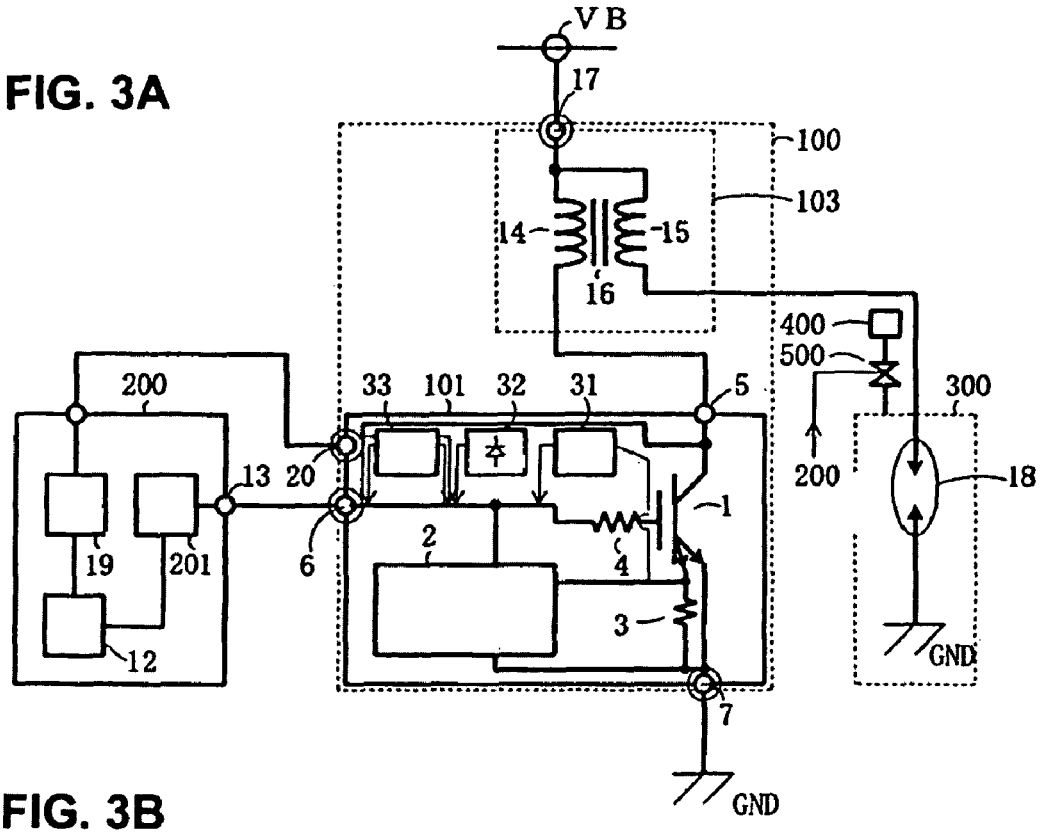
FIGS. 3A-3C are a block circuit diagram, a timing chart, and a waveform comparison diagram, respectively, illustrating an igniter system according to a second embodiment of the invention.
Figure 3B:
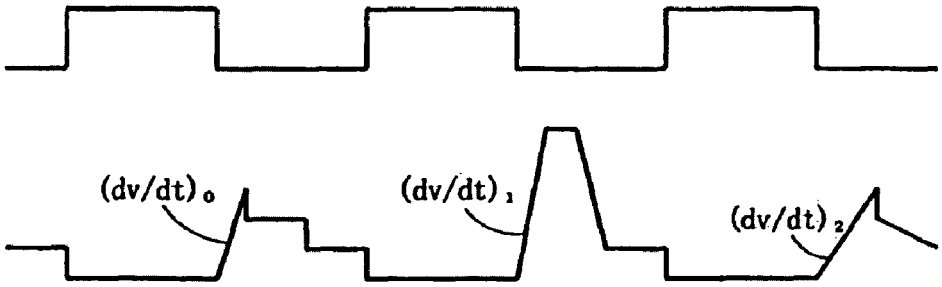
Figure 3C:
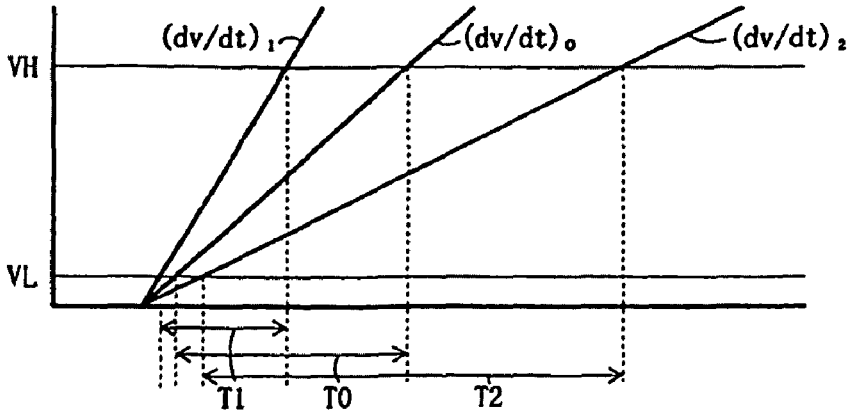

FIGS. 3A-3C illustrate an igniter system according to a second embodiment of the invention. FIG. 3A is a block circuit diagram of the igniter system, FIG. 3B is a timing chart, and FIG. 3C is a waveform comparison diagram. The third embodiment is directed to a case that a function of detecting a coil failure is provided in the ECU 200.

The second embodiment is of a voltage detection type and is of a type that a turn-off collector voltage is output to the ECU 200 as it is. The ECU 200 directly detects an abnormality in the manner of rise of a collector voltage if it occurs. A dv/dt detection circuit 19 for detecting an increase rate dv/dt of the collector voltage v and a timer circuit 12 which judges whether a coil abnormality has occurred in response to a signal that is supplied from a dv/dt detection circuit are provided in the ECU 200.

When a coil abnormality has occurred, the coil inductance is varied and the increase rate dv/dt of the turn-off collector voltage is thereby varied.

In FIG. 3B, left-hand waveforms correspond to a case that dv/dt exhibits a normal value $(dv/dt)_0$. Central waveforms correspond to a case that dv/dt exhibits a large value $(dv/dt)_1$ due to a coil abnormality. Right-hand waveforms correspond to a case that dv/dt exhibits a small value $(dv/dt)_2$ due to a coil abnormality.

FIG. 3C compares a normal rise and abnormal rises of the collector voltage that are shown in FIG. 3B. An increase rate dv/dt is detected by detection of a collector voltage and time measurement by the timer circuit. A low voltage level VL and a high voltage level VH are set in advance. A collector voltage detection value is compared with the low and high voltage levels and comparison results are transmitted to the timer circuit of the ECU 200 shown in FIG. 3A. The timer circuit measures a time T (T0, T1, or T2) from a time point when the collector voltage reaches the low voltage level VL to a time point when it reaches the high voltage level VH. The measured time T corresponds to a signal for failure detection.

The ECU 200 judges whether a coil abnormality has occurred by judging a magnitude (slope) of dv/dt comparing the time T measured by the timer circuit 12 with reference time lengths. In a normal state (i.e., a state that no coil abnormality has occurred), the time T0 measured by the timer circuit is almost constant. The ECU 200 compares the length T0 with reference time lengths TrefL and TrefH. TrefL and TrefH are a lower limit reference value and an upper limit reference value to be used for judgment as to whether the magnitude (slope) of dv/dt is normal.

The waveforms shown at the center of FIG. 3B correspond to a case that the collector voltage rises more steeply $((dv/dt)_1)$ due to a coil abnormality. If the rise rate dv/dt of the collector voltage v is made higher due to a coil failure, the time from a time point when the collector voltage reaches the VL level to a time point when it reaches the VH level becomes shorter. Therefore, the time length T1 measured by the timer circuit 12 of the ECU 200 is shorter than the time length T0 of the normal state.

The time length T1 is compared with TrefL and TrefH. If T1<TrefL, the ECU 200 judges that a coil abnormality has occurred and outputs a signal for stopping the igniter system. The igniter system hereafter operates in the same manner as in the first embodiment. The right-hand waveforms in FIG. 3B correspond to a case that the collector voltage rises more gently due to a coil abnormality. If the rise rate dv/dt of the collector voltage v is made lower $((dv/dt)_2)$, the time length T2 becomes longer. The time length T2 is compared with TrefL and TrefH. If T2>TrefH, the ECU 200 judges that a coil abnormality has occurred and outputs a signal for stopping the igniter system. The igniter system hereafter operates in the same manner as in the first embodiment. This scheme causes no influence on the gate voltage waveform and hence makes it possible to detect a coil failure with high accuracy.

In this scheme, the power IC 101 requires a collector terminal 20 for connection to the ECU 200. Therefore, the power IC 101 has four terminals, that is, the collector terminal 5, the gate terminal 6, the emitter terminal 7, and the newly-provided collector terminal 20. And the ignition device 100 which incorporates the power IC 101 has four terminals, that is, the VB terminal 17, the gate terminal 6, the emitter terminal 7, and the newly-provided collector terminal 20.

Embodiment 3

Figure 4A:
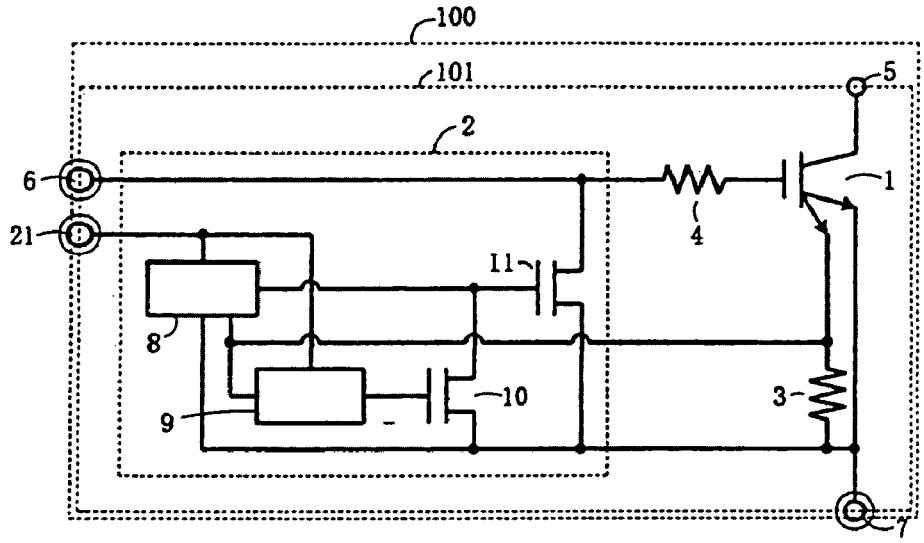
FIGS. 4A and 4B are a block circuit diagram of an IGBT 1 and a coil failure detection circuit 2 and a timing chart, respectively, illustrating an igniter system according to a third embodiment of the invention.
Figure 4B:
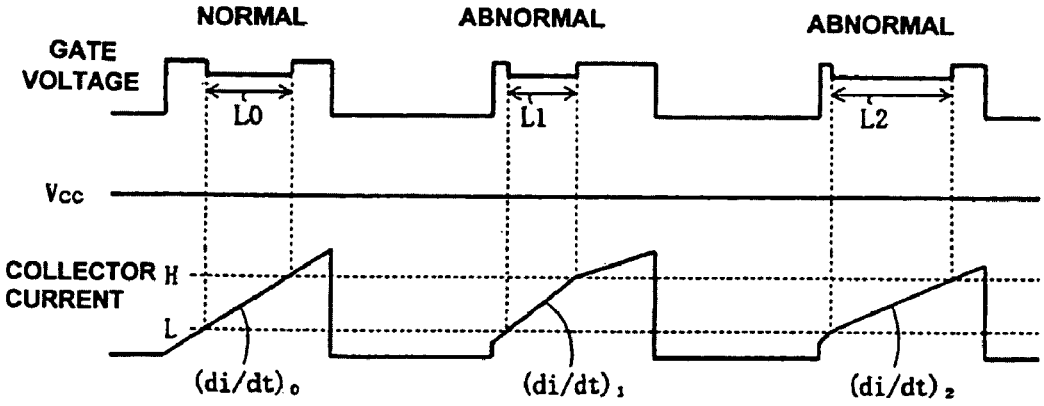

FIGS. 4A and 4B illustrate an igniter system according to a third embodiment of the invention. FIG. 4A is a block circuit diagram of an IGBT 1 and a coil failure detection circuit 2, and FIG. 4B is a timing chart. The circuit of FIG. 4B is different from that of FIG. 2A in that the voltage that is applied to the L current detection circuit 8 and the H current detection circuit 9 is supplied from a Vcc terminal 21 which is a power supply terminal rather than from the gate terminal 6. The timing chart of FIG. 4B will not be described because it is the same as FIG. 1B. In this scheme, since the Vcc terminal 21 is necessary, the power IC 101 has four terminals, that is, the collector terminal 5, the gate terminal 6, the emitter terminal 7, and the Vcc terminal 21. And the ignition device 100 which incorporates the power IC 101 has four terminals, that is, the VB terminal 17, the gate terminal 6, the emitter terminal 7, and the Vcc terminal 21.

Embodiment 4

Figure 5A:
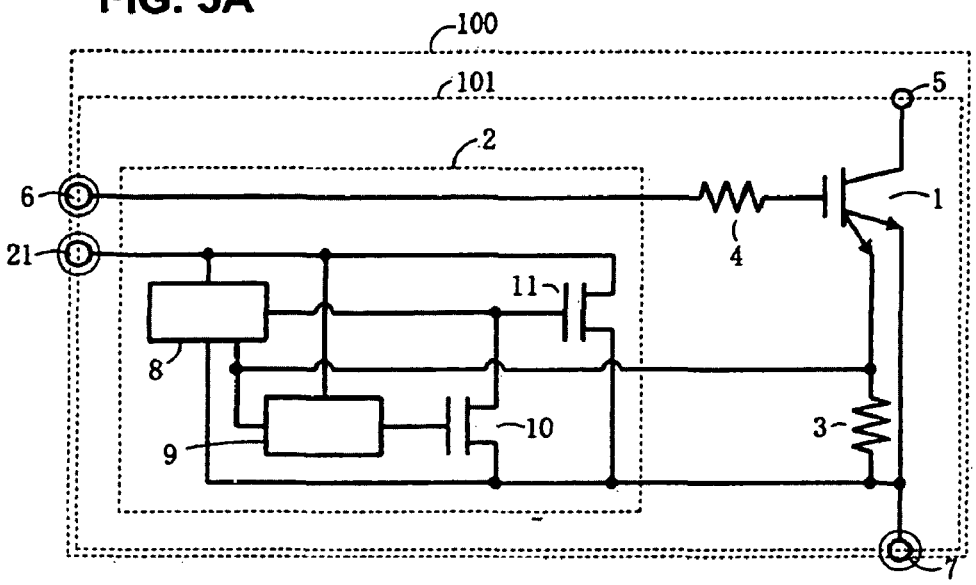
FIGS. 5A and 5B are a block circuit diagram of an IGBT 1 and a coil failure detection circuit 2 and a timing chart, respectively, illustrating an igniter system according to a fourth embodiment of the invention.
Figure 5B:
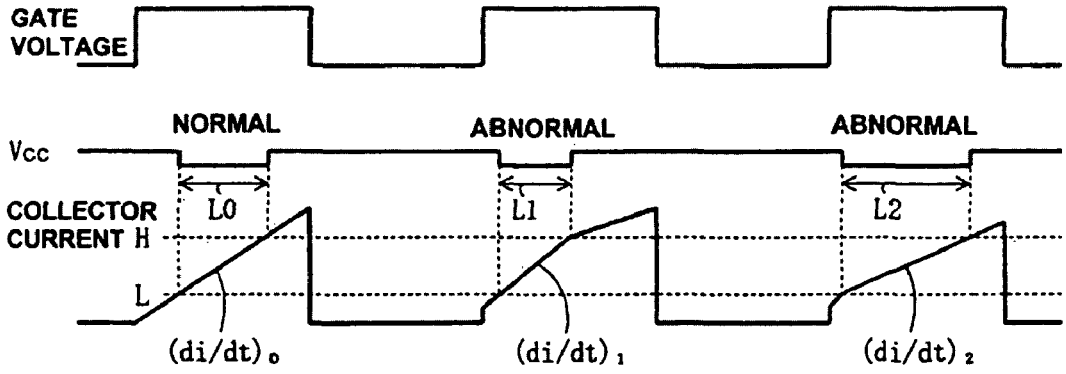

FIGS. 5A and 5B illustrate an igniter system according to a fourth embodiment of the invention. FIG. 5A is a block circuit diagram of an IGBT 1 and a coil failure detection circuit 2, and FIG. 5B is a timing chart. The fourth embodiment is of a current detection type because an L current detection circuit 8 and an H current detection circuit 9 monitor the rise of a collector current. And the fourth embodiment is of a type that instead of the gate voltage of the IGBT 1 the voltage (Vcc voltage) of a Vcc terminal 21 is pulled down according to the relationships between the collector current and threshold values (L level and H level) of the current detection circuits 8 and 9. A Vcc power source (not shown) which is connected to the Vcc terminal 21 is a low voltage source that is separate from a main power source VB (also called a VB power source). The Vcc terminal 21 is connected to a timer circuit 12 of an ECU 200. Whether a coil failure has occurred is judged by inputting a pulled-down Vcc voltage to the timer circuit 12 and measuring the length of a pull-down period.

The coil failure judgment method that is employed in the ECU 200 is the same as in the first embodiment. Since a pull-down signal is sent to the timer circuit 12 of the ECU 200 (see FIG. 1) via the Vcc terminal 21, this scheme causes no influence on the gate voltage waveform and hence makes it possible to detect a coil failure with high accuracy. In this scheme, the power IC 101 has four terminals, that is, the collector terminal 5, the gate terminal 6, the emitter terminal 7, and the Vcc terminal 21. And the ignition device 100 which incorporates the power IC 101 has four terminals, that is, the VB terminal 17, the gate terminal 6, the emitter terminal 7, and the Vcc terminal 21.

Embodiment 5

Figure 6A:
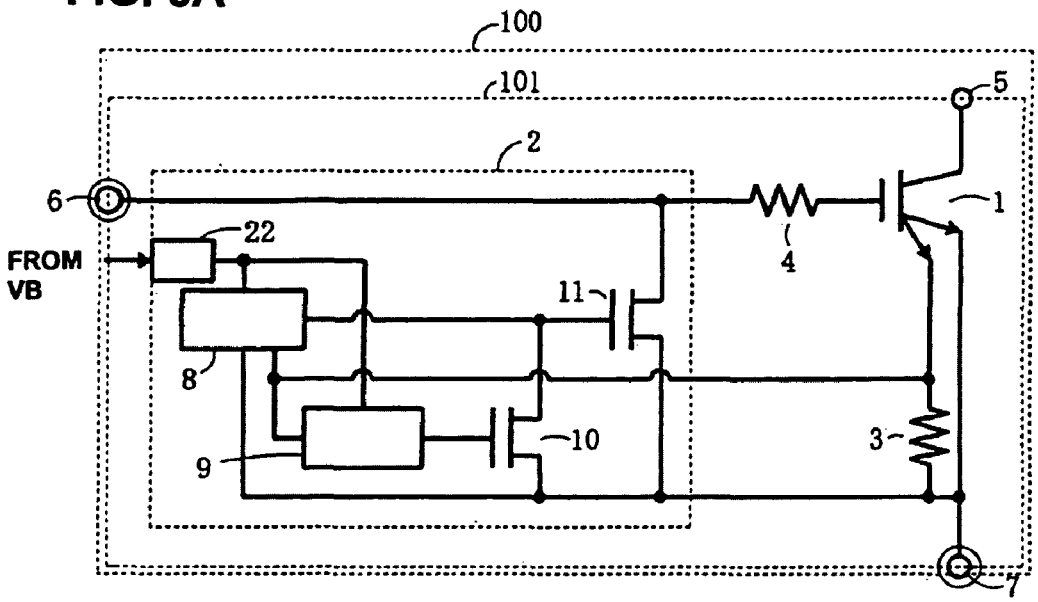
FIGS. 6A and 6B are a block circuit diagram of an IGBT 1 and a coil failure detection circuit 2 and a timing chart, respectively, illustrating an igniter system according to a fifth embodiment of the invention.
Figure 6B:
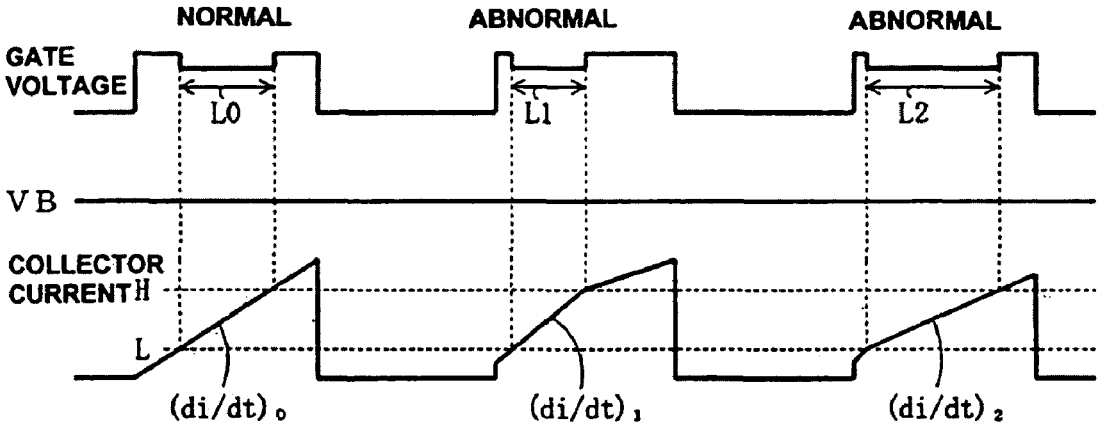

FIGS. 6A and 6B illustrate an igniter system according to a fifth embodiment of the invention. FIG. 6A is a block circuit diagram of an IGBT 1 and a coil failure detection circuit 2, and FIG. 6B is a timing chart. The fifth embodiment is of a current detection type because an L current detection circuit 8 and an H current detection circuit 9 monitor the rise of a collector current. And the fifth embodiment is of a type that the gate voltage of the IGBT 1 is pulled down according to the relationships between the collector current and threshold values (L level and H level) of the current detection circuits 8 and 9. In this scheme, since the VB terminal 17 shown in FIG. 1 is used, the power IC 101 has three terminals, that is, the collector terminal 5, the gate terminal 6, and the emitter terminal 7. And the ignition device 100 which incorporates the power IC 101 has three terminals, that is, the VB terminal 17, the gate terminal 6, and the emitter terminal 7.

Embodiment 6

Figure 7A:
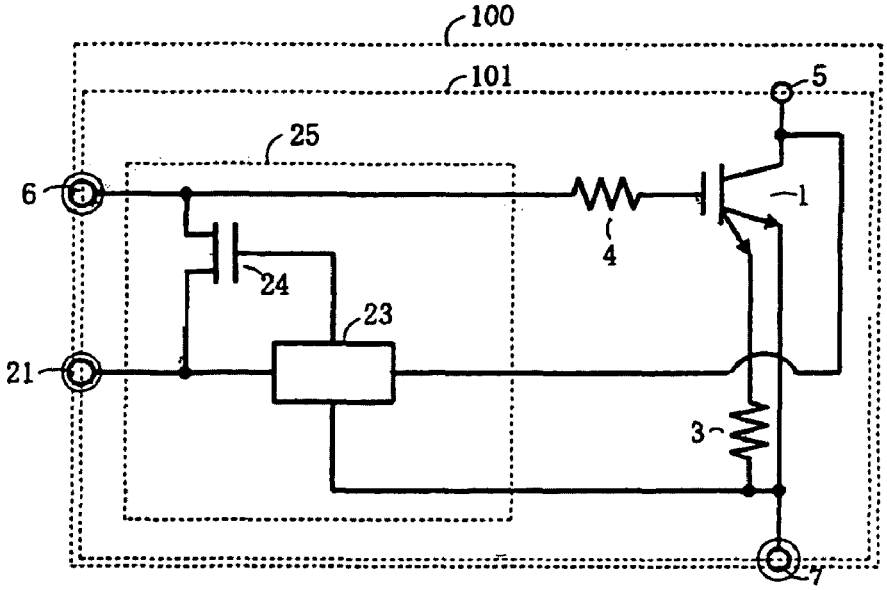
FIGS. 7A and 7B are a block circuit diagram of an IGBT 1 and a coil failure detection circuit 25 and a timing chart, respectively, illustrating an igniter system according to a sixth embodiment of the invention.
Figure 7B:
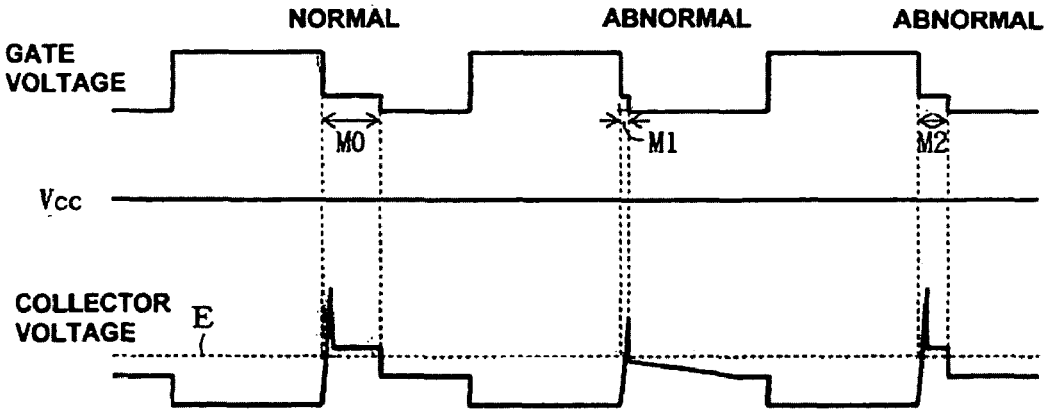

FIGS. 7A and 7B illustrate an igniter system according to a sixth embodiment of the invention. FIG. 7A is a block circuit diagram of an IGBT 1 and a coil failure detection circuit 25, and FIG. 7B is a timing chart. The coil failure detection circuit 25 is of a voltage detection type and is composed of a voltage level detection circuit 23 and an NMOS 24. The NMOS 24 for pulling up a gate voltage is inserted between a gate terminal 6 and a Vcc terminal 21, and a voltage that is applied to the voltage level detection circuit 23 is supplied from the Vcc terminal 21. The term "pull-up" is used here because the gate voltage of the IGBT 1 is increased slightly in a period when the gate voltage is at an L level. The coil failure judgment method that is employed in the ECU 200 is the same as in the first embodiment. A voltage by which the gate voltage is pulled up is set in such a range as not influence the on-characteristic of the IGBT 1. That is, the IGBT 1 should not be turned on erroneously even if the gate voltage is pulled up. In this embodiment, the pull-up voltage is set at about 0.5 V.

The sixth embodiment is of a voltage detection type because a turn-off collector voltage (turn-off voltage) is monitored by the voltage level detection circuit 23 in which a prescribed voltage level E is set. And the sixth embodiment is of a type that the gate voltage is pulled up if the turn-off voltage is higher than the prescribed voltage (threshold value of the voltage level detection circuit 23: voltage level E). In this scheme, since a Vcc terminal 21 is used, the power IC 101 has four terminals, that is, the collector terminal 5, the gate terminal 6, the emitter terminal 7, and the Vcc terminal 21. And the ignition device 100 which incorporates the power IC 101 has four terminals, that is, the VB terminal 17, the gate terminal 6, the emitter terminal 7, and the Vcc terminal 21.

Embodiment 7

Figure 8A:
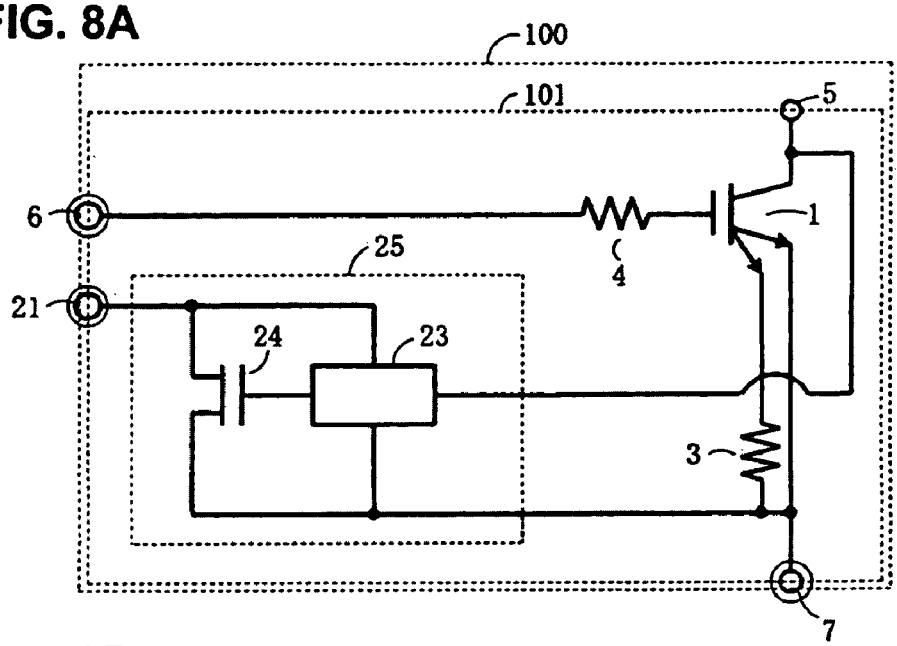
FIGS. 8A and 8B are a block circuit diagram of an IGBT 1 and a coil failure detection circuit 25 and a timing chart, respectively, illustrating an igniter system according to a seventh embodiment of the invention.
Figure 8B:
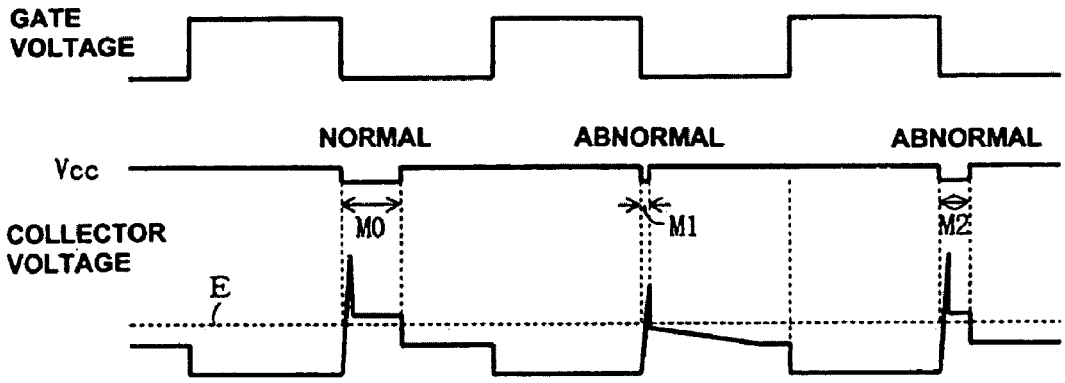

FIGS. 8A and 8B illustrate an igniter system according to a seventh embodiment of the invention. FIG. 8A is a block circuit diagram of an IGBT 1 and a coil failure detection circuit 25, and FIG. 8B is a timing chart. An NMOS 24 for pulling down a Vcc voltage is inserted between a Vcc terminal 21 and the ground, and a voltage that is applied to a voltage level detection circuit 23 is supplied from the Vcc terminal 21. A pulled-down Vcc voltage is transmitted to a timer circuit 21 and used for coil failure judgment. The coil failure judgment method that is employed in the ECU 200 is the same as in the first embodiment.

The seventh embodiment is of a voltage detection type because a turn-off voltage is monitored by the voltage level detection circuit 23 in which a prescribed voltage level is set. And the seventh embodiment is of a type that the Vcc voltage is pulled down by turning on the NMOS 24 if the turn-off voltage is higher than the preset voltage. In this scheme, as in the sixth embodiment, since the Vcc terminal 21 is used, the power IC 101 has four terminals, that is, the collector terminal 5, the gate terminal 6, the emitter terminal 7, and the Vcc terminal 21. And the ignition device 100 which incorporates the power IC 101 has four terminals, that is, the VB terminal 17, the gate terminal 6, the emitter terminal 7, and the Vcc terminal 21. This scheme causes no influence on the gate voltage waveform and hence makes it possible to detect a coil failure with high accuracy.

Embodiment 8

Figure 9A:
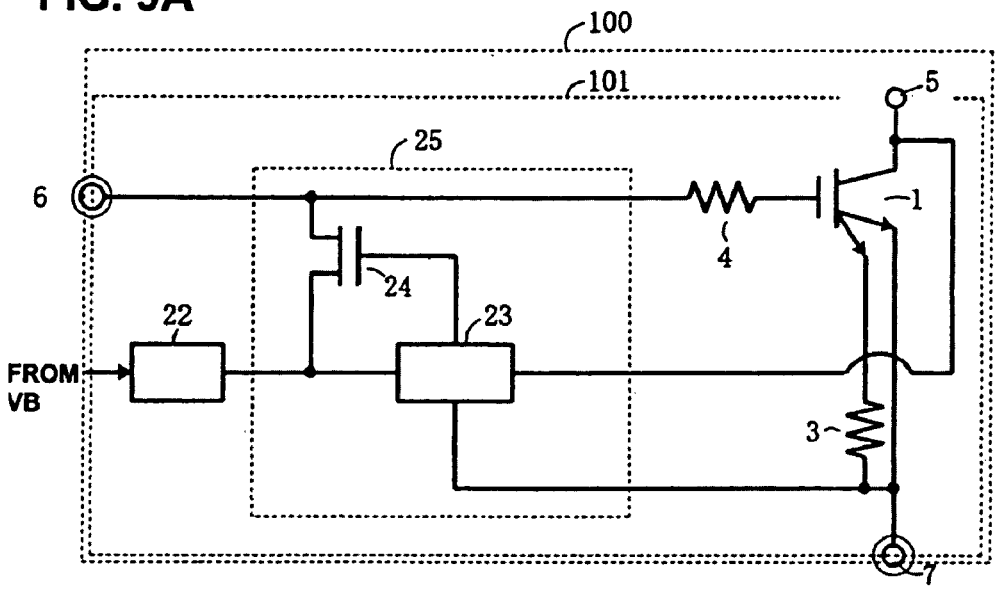
FIGS. 9A and 9B are a block circuit diagram of an IGBT 1 and a coil failure detection circuit 25 and a timing chart, respectively, illustrating an igniter system according to an eighth embodiment of the invention.
Figure 9B:
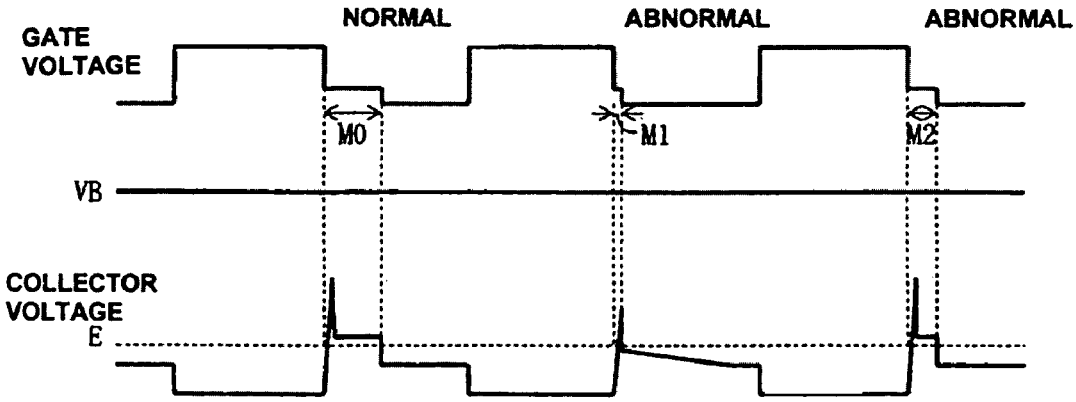

FIGS. 9A and 9B illustrate an igniter system according to an eighth embodiment of the invention. FIG. 9A is a block circuit diagram of an IGBT 1 and a coil failure detection circuit 25, and FIG. 9B is a timing chart. The circuit of FIG. 9A is different from that of FIG. 7A in that a VB power source is used instead of the Vcc power source and the voltage of the VB power source is used after being lowered by a voltage reduction circuit 22.

The eighth embodiment is of a voltage detection type because a turn-off collector voltage is monitored by a voltage level detection circuit 23 in which a prescribed voltage level E is set. And the eighth embodiment is of a type that a gate voltage is pulled down if the collector voltage is higher than the prescribed voltage. The coil failure judgment method that is employed in the ECU 200 is the same as in the first embodiment. In this scheme, since the VB terminal 17 is used, the power IC 101 has three terminals, that is, the collector terminal 5, the gate terminal 6, and the emitter terminal 7. And the ignition device 100 which incorporates the power IC 101 has three terminals, that is, the VB terminal 17, the gate terminal 6, and the emitter terminal 7.

Embodiment 9

Figure 10A:
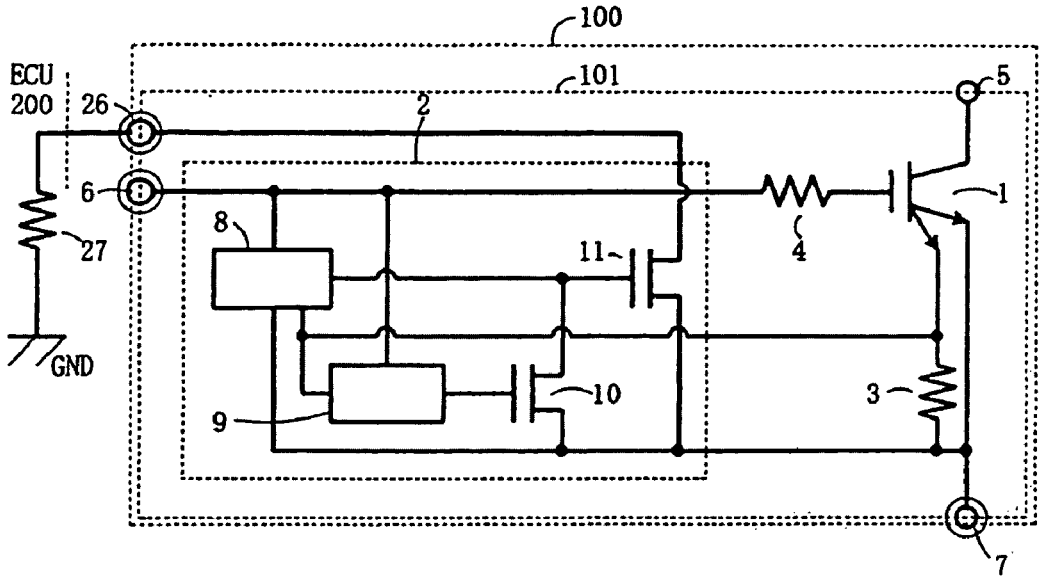
FIGS. 10A and 10B are a block circuit diagram of an IGBT 1 and a coil failure detection circuit 2 and a timing chart, respectively, illustrating an igniter system according to a ninth embodiment of the invention.
Figure 10B:
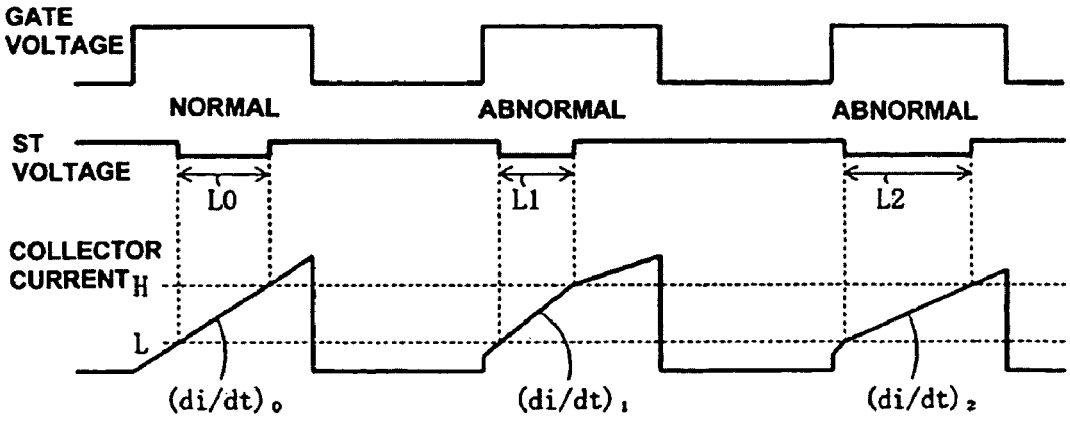

FIGS. 10A and 10B illustrate an igniter system according to a ninth embodiment of the invention. FIG. 10A is a block circuit diagram of an IGBT 1 and a coil failure detection circuit 2, and FIG. 10B is a timing chart. In FIG. 10A, reference numeral 26 denotes an ST terminal through which a reference potential that is provided inside an ECU 200 is input to a power IC 101.

The ninth embodiment is of a current detection type because an L current detection circuit 8 and an H current detection circuit 9 monitor the rise of a collector current. And the ninth embodiment is of a type that an ST voltage is pulled down according to the relationships between the collector current and threshold values (L level and H level) of the current detection circuits 8 and 9. A signal is sent to a timer circuit 12 of the ECU 200 via the ST terminal 26 and used for coil failure judgment. The coil failure judgment method that is employed in the ECU 200 is the same as in the first embodiment. The ST terminal 26 is connected to a resistor 27 which is formed in the ECU 200. By virtue of the use of the ST terminal 26 voltage, this scheme causes no influence on the gate voltage waveform and hence makes it possible to detect a coil failure with high accuracy. In this scheme, since the ST terminal 26 is used, the power IC 101 has four terminals, that is, the collector terminal 5, the gate terminal 6, the emitter terminal 7, and the ST terminal 26. And the ignition device 100 which incorporates the power IC 101 has four terminals, that is, the VB terminal 17, the gate terminal 6, the emitter terminal 7, and the ST terminal 26.

Embodiment 10

Figure 11A:
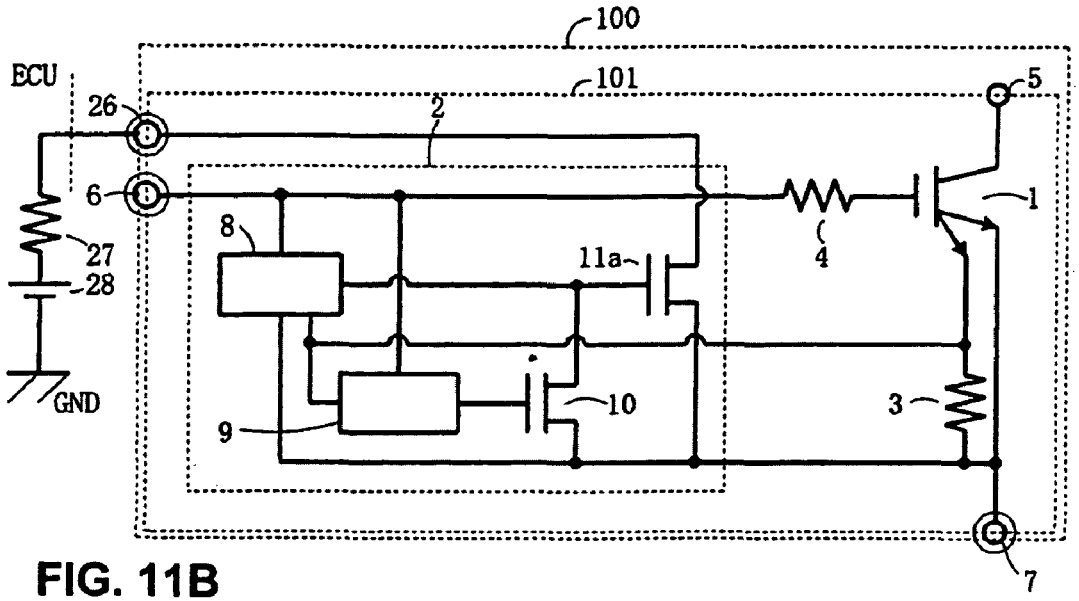
FIGS. 11A and 11B are a block circuit diagram of an IGBT 1 and a coil failure detection circuit 2 and a timing chart, respectively, illustrating an igniter system according to a 10th embodiment of the invention.
Figure 11B:
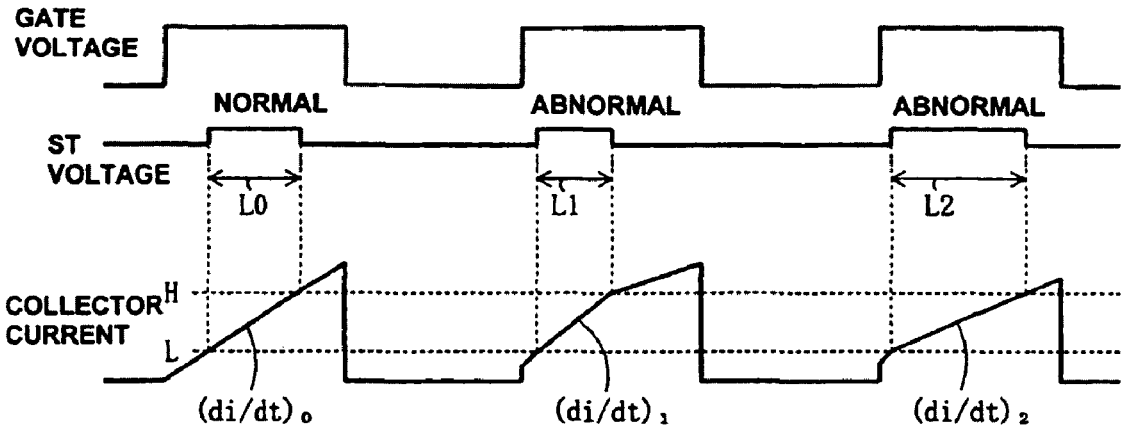
Figure 12:
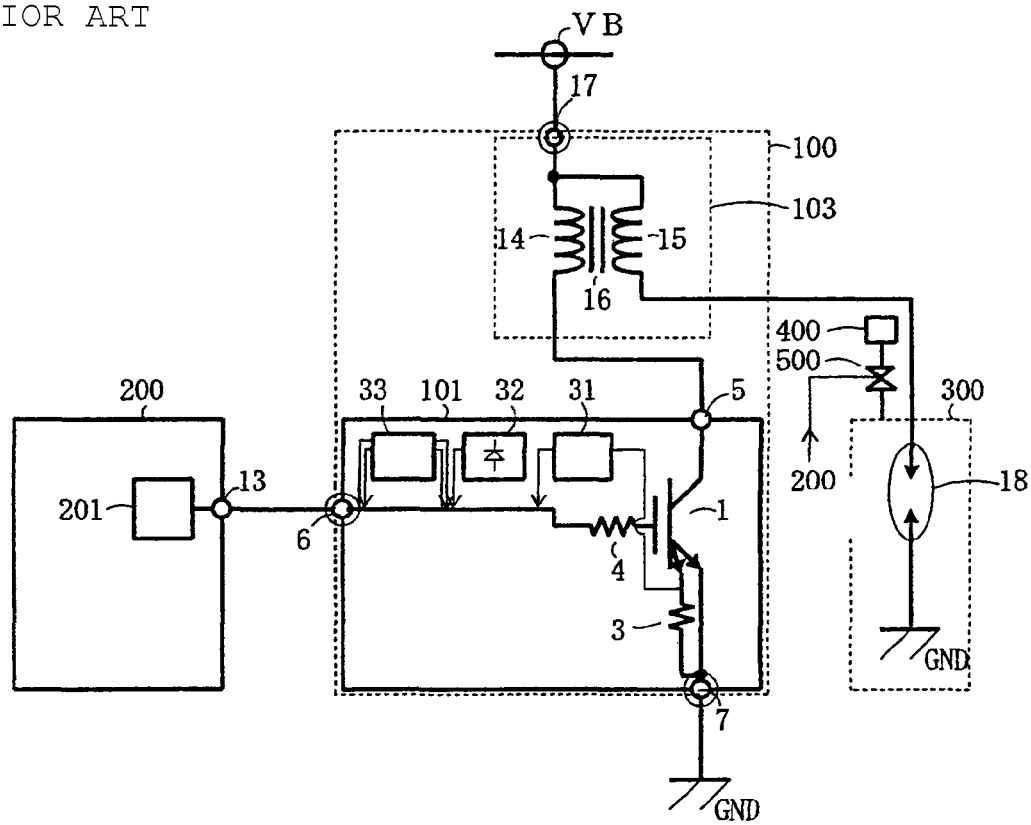
FIG. 12 PRIOR ART
FIG. 12 is a block circuit diagram of a conventional igniter system.

FIGS. 11A and 11B illustrate an igniter system according to a 10th embodiment of the invention. FIG. 11A is a block circuit diagram of an IGBT 1 and a coil failure detection circuit 2, and FIG. 11B is a timing chart. The 10th embodiment is of a current detection type because an L current detection circuit 8 and an H current detection circuit 9 monitor the rise of a collector current. And the tenth embodiment is of a type that an ST voltage is pulled up according to the relationships between the collector current and threshold values (L level and H level) of the current detection circuits 8 and 9. A signal is sent to a timer circuit 12 of an ECU 200 via an ST terminal 26 and used for coil failure judgment. The ST terminal 26 is connected to a resistor 27 and a power source 28 that are provided in the ECU 200. The coil failure judgment method that is employed in the ECU 200 is the same as in the first embodiment. By virtue of the use of the ST terminal 26 voltage, this scheme causes no influence on the gate voltage waveform and hence makes it possible to detect a coil failure with high accuracy. In this scheme, as in the ninth embodiment, since the ST terminal 26 is used, the power IC 101 has four terminals and the ignition device 100 which incorporates the power IC 101 has four terminals.

The invention has been described with reference to certain preferred embodiments thereof. It will be understood, however, that modifications and variations are possible within the scope of the appended claims.

This application is based on, and claims priority to, Japanese Patent Application No: 2007-313397, filed on Dec. 4, 2007. The disclosure of the priority application, in its entirety, including the drawings, claims, and the specification thereof, is incorporated herein by reference.

What is claimed is:

1. An igniter system comprising:
an ignition coil;
a switching element for turning on and off a current flowing through the ignition coil; and
a control circuit for the switching element, the control circuit comprising:
a current detecting device that detects a current flowing through the switching element;
a measuring device that measures a length of a period from a time point when the current flowing through the switching element that is increasing exceeds a first current setting value to a time point when it reaches a second current setting value that is larger than the first current setting value;
a judgment circuit for judging whether the measured length of the period is either shorter than a preset lower limit reference length or longer than a preset upper limit reference length; and
an output device that outputs a signal for turning off the switching element if the judgment circuit judges that the measured length of the period is shorter than the lower limit reference length or longer than the upper limit reference length.

2. An igniter system comprising:
a power IC in which an ignition coil and a switching element for turning on and off a current flowing through the ignition coil are integrated together;
an engine control unit for controlling the switching element and performing engine control; and
a combustion chamber;
wherein the power IC comprises:
a current detecting device that detects a current flowing through the switching element; and
an output device that outputs, to the engine control unit, a signal for failure detection during a period from a time point when the current flowing through the switching element that is increasing exceeds a first current setting value to a time point when it reaches a second current setting value that is larger than the first current setting value; and
wherein the engine control unit comprises:
a timer circuit for measuring a duration of the signal for failure detection;
a judgment circuit for judging whether the measured duration is either shorter than a preset lower limit reference length or longer than a preset upper limit reference length; and
stop signal output device that judges that the ignition coil has failed and outputs a stop signal for stopping the igniter system if the judgment circuit judges that the measured duration is shorter than the lower limit reference length or longer than the upper limit reference length.

3. The igniter system according to claim 2, wherein the output device comprises a switching device that pulls down a gate voltage of the switching element during the period from the time point when the current flowing through the switching element that is increasing exceeds the first current setting value to the time point when it reaches the second current setting value; and wherein the timer circuit measures a length of the period when the gate voltage is pulled down.

4. The igniter system according to claim 3, wherein the current detecting device comprises an L current detection circuit for outputting information indicating that the current flowing through the switching element has reached the first current setting value and an H current detection circuit for outputting information indicating that the current flowing through the switching element has reached the second current setting value; and wherein the switching device is set by the output signal of the L current detection circuit and is reset by output signal of the H current detection circuit.

5. The igniter system according to claim 2, wherein the power IC comprises a Vcc terminal for connection to an external power source; wherein the output device comprises a switching device that pulls down a voltage of the Vcc terminal during the period from the time point when the current flowing through the switching element that is increasing exceeds the first current setting value to the time point when it reaches the second current setting value; and wherein the timer circuit measures a length of the period when the voltage of the Vcc terminal is pulled down.

6. The igniter system according to claim 5, wherein the current detecting device comprises an L current detection circuit for outputting information indicating that the current flowing through the switching element has reached the first current setting value and an H current detection circuit for outputting information indicating that the current flowing through the switching element has reached the second current setting value; and wherein the switching device is set by the output signal of the L current detection circuit and is reset by output signal of the H current detection circuit.

7. The igniter system according to claim 2, wherein the power IC comprises an ST terminal through which is received a reference potential of the engine control unit;

wherein the output device comprises a switching device that pulls up or down a voltage of the ST terminal during the period from the time point when the current flowing through the switching element that is increasing exceeds the first current setting value to the time point when it reaches the second current setting value; and wherein the timer circuit measures a length of the period when the voltage of the ST terminal is pulled up or down.

8. The igniter system according to claim 7, wherein the current detecting device comprises an L current detection circuit for outputting information indicating that the current flowing through the switching element has reached the first current setting value and an H current detection circuit for outputting information indicating that the current flowing through the switching element has reached the second current setting value; and wherein the switching device is set by the output signal of the L current detection circuit and is reset by output signal of the H current detection circuit.

9. The igniter system according to claim 2, wherein the stop signal is at least one of a signal for turning off the switching element and a signal for shutting off fuel being supplied to the combustion chamber.

10. The igniter system according to claim 2, wherein a low voltage circuit is integrated in the power IC, and a voltage of a main power source for operation of the ignition coil is supplied to the low voltage circuit as a power supply voltage after being lowered by a voltage reduction circuit.

* * * * *